United States Patent [19]

Sabo

[11] Patent Number: 5,026,245

[45] Date of Patent: Jun. 25, 1991

[54] CLAMPING ARRANGEMENT FOR A LIFT MAST

[75] Inventor: Joseph F. Sabo, Lyndhurst, Ohio

[73] Assignee: Caterpillar Industrial Inc., Mentor, Ohio

[21] Appl. No.: 373,301

[22] Filed: Jun. 29, 1989

[51] Int. Cl.[5] ..... B66F 9/18

[52] U.S. Cl. ..... 414/622; 414/785; 414/621; 414/730; 187/9 R; 294/907; 294/88; 901/34; 901/47; 901/37

[58] Field of Search ..... 414/620, 621, 622, 618, 414/619, 783, 744.8, 751, 753, 729, 730, 731, 732, 733, 734, 735, 736, 378, 739, 740, 741, 222; 901/31, 32, 33, 34, 35, 36, 37, 38, 47; 294/902, 901, 88, 86.18, 87.28, 119.11

[56] References Cited

U.S. PATENT DOCUMENTS

| | | | |
|---|---|---|---|
| 1,876,219 | 9/1932 | Gfrorer | 414/622 |
| 2,635,774 | 4/1953 | Backofen et al. | 414/620 |
| 2,661,857 | 12/1953 | McNutt | 414/622 |
| 3,024,929 | 3/1962 | Shimmon | 414/622 X |
| 4,029,230 | 6/1977 | Bolduc et al. | 414/622 |
| 4,341,354 | 7/1982 | Liet et al. | 414/622 X |
| 4,579,380 | 4/1986 | Zaremsky et al. | 294/907 X |
| 4,600,357 | 7/1986 | Coules | 901/34 X |
| 4,726,729 | 2/1988 | Olson et al. | 414/621 |
| 4,751,983 | 6/1988 | Leskovec et al. | 187/9 R |

FOREIGN PATENT DOCUMENTS

| | | | |
|---|---|---|---|
| 561958 | 5/1957 | Italy | 414/622 |
| 93742 | 2/1959 | Norway | 414/622 |
| 1271815 | 11/1986 | U.S.S.R. | 414/621 |

*Primary Examiner*—Frank E. Werner
*Attorney, Agent, or Firm*—Alan J. Hickman

[57] ABSTRACT

A clamping arrangement for stabilizing a load carried on an elevationally movable load engaging device of a material handling lift mast has a clamp movably connected to the load engaging device and an actuator for moving the load engaging clamp between first and second spaced apart locations in response to the actuator being moved between extended and retracted positions. A connecting device connects the actuator to the load engaging device and maintains the load engaging clamp from movement toward the second position in response to engagement between the load engaging clamp and the load and provides a preselected amount of movement of the actuator relative to the load engaging clamp subsequent to engagement between the load engaging clamp and the load and thus reduces the potential of damaging the load. The clamping arrangement is particularly suited for use on an automatic guided vehicle.

11 Claims, 3 Drawing Sheets

14
18
33
46
82
48
56
60
58
52
28
54
50
62
64
78
42
44
162
41
41
160
66
66
158
30
80
40
38
76
74
86
84
72
72
142
84
34
88
36
39
42
68
70
26
27
31
32
32
20
29
22
32
32
24

CLAMPING ARRANGEMENT FOR A LIFT MAST

DESCRIPTION

1. Technical Field

This invention relates to a clamping arrangement for stabilizing a load on a load engaging device of a material handling lift mast and more particularly to a clamping arrangement in which a connecting device maintains a load engaging clamp from movement, permits a preselected amount of actuator movement relative to the load engaging clamp, and limits the applied force of the load engaging clamp against the load to a preselected magnitude.

2. Background Art

Material handling vehicles for transporting a load between pick-up and deposit locations have been in use for decades in facilities such as, factories, warehouses, and the like. Such material handling vehicles have lift masts mounted thereon for elevationally lifting the load so that the load may be transported to another location and deposited. Such lift masts typically have a carriage which is mounted on uprights of the lift mast and selectively positionable at a desired elevational position. Usually, a pair of spaced apart forks are mounted on the carriage and positionable beneath the load so that the load may be lifted in response to elevational movement of the carriage. In situations where the load to be lifted is tall in the elevational direction and narrow in the other directions the potential for inadvertent tipping under the dynamics of vehicle operation exists. Also, loads carried on the forks which are light in weight tend to have a higher incidence of inadvertent movement on the forks caused by the vehicle dynamics. As a result of either of the above conditions successful load transfer and accurate load positioning are in jeopardy. In addition, operation of the vehicle on rough floors at normal speeds will be impossible because of the aforementioned load instability and movement problems. As a result, the speed of load transfer is reduced which adversely affects the amount of work being accomplished for a given period of time. Therefore, load stability and immobility must be improved in order to over come these problems.

In applications where the lift mast is mounted on a driverless automatic guided vehicle (AGV), especially of the type having free ranging capabilities (the ability to operate without guide wires and stripes on the floor), the need for accurate load positioning on the forks is extremely important. AGVs of this type rely on information stored in memory in an onboard computer and signals delivered from sensors on the vehicle to locate and position the vehicle relative to the load and to position the forks at the desired location relative to the load. In order to accurately pick up and deposit a load the position of the load on the forks must remain static and not move inadvertently. If such inadvertent movement of the load on the forks occurs the expected position and actual position of the load being deposited will ultimately be in error an amount great enough to adversely effect subsequent load pick-up and deposit. It is noted that load position error will compound as the number of load movement cycles increase ultimately resulting in the forks being unable to be aligned with the load. This problem of inadvertent load movement needs to be overcome if successful operation of the AGV is to be achieved.

Load engaging clamps have been known for some time which are capable of clampingly engaging a load from its side for the purpose of picking up and transporting the load to a deposit location. Such load clamps typically utilize hydraulic cylinders or electric motors which are actuatable for moving a pair of clamp arms to squeeze the load until an adequate amount of force is applied to the load so that the load may be secured between the arms for lifting. In many applications such clamps are not suitable as the load is unable to accept the amount of force required to adequately engage and support the load for lifting purposes without damaging the load.

Load engaging clamps which utilize hydraulic cylinders often have control systems with multiple settings to provide a plurality of different fluid pressures and thus different clamping forces. Clamps which utilize electric motors may have their clamping force controlled by the regulation of current to the electric motors. An example of an electric motor powered clamp is shown in U.S. Pat. No. 4,726,729 to John E. Olson et.al. dated Feb. 23, 1988. This patent teaches the control of different clamping forces for an automatic guided vehicle mounted clamp by sensing the current driving the clamping motors and regulates the current controller in response to the sensed current. In both the hydraulic and electrically controlled clamps the control system is complex and tends to be expensive and unreliable. Changes in the values of the preset conditions of the hydraulic and electric control systems caused by factors such as heat, wear, friction and the like will occur which will cause the clamping forces to inadvertently change. This change when great enough will result in either an excessive force of the clamp and damage to the load or an inadequate clamp force and the inability to carry the load.

The present invention is directed to overcoming one or more of the problems as set forth above.

DISCLOSURE OF THE INVENTION

In one aspect of the present invention, a clamping arrangement for stabilizing a load carried on an elevationally movable load engaging device of a material handling lift mast is provided. A load engaging clamp is connected to the load engaging device and movable between first and second spaced apart positions relative to the load engaging device. An actuator is provided for moving the load engaging clamp between first and second positions in response to movement between an extended position and a retracted position thereof. The actuator is connected to one of the load engaging device and load engaging clamp. A connecting device connects the actuator to the other one of the load engaging device and the load engaging clamp and maintains the load engaging clamp from movement toward the second position in response to engagement between the load engaging clamp and the load. The connecting device provides a preselected amount of movement of the actuator means relative to the load engaging clamp subsequent to engagement between the load engaging clamp and the load.

In another aspect of the present invention a material handling vehicle has a frame, a lift mast assembly mounted on the frame, and a load engaging device. The load engaging device has a carriage and a plurality of load engaging forks mounted on the carriage. The carriage is mounted on the lift mast and elevationally movable along the lift mast between spaced apart locations.

A load engaging clamp is mounted on the load engaging device and elevationally movable relative to the load engaging forks between first and second elevationally spaced apart locations. An actuator has a housing and a rod connected to the housing and extensibly movable relative to the housing between extended and retracted positions. The rod is connected to the load engaging clamp and movable between the first and second positions in response to movement of the rod between the extended and retracted positions. A connecting device connects the housing to the carriage and maintains the load engaging clamp from movement toward the second position in response to engagement between the load engaging clamp and the load. The connecting device permits a preselected amount of extension of the actuator relative to the load engaging clamp subsequent to engagement between the load engaging clamp and the load, and limits the applied force of the load engaging clamp against the load to a preselected magnitude.

BEST MODE FOR CARRYING OUT THE INVENTION

Figure 1:
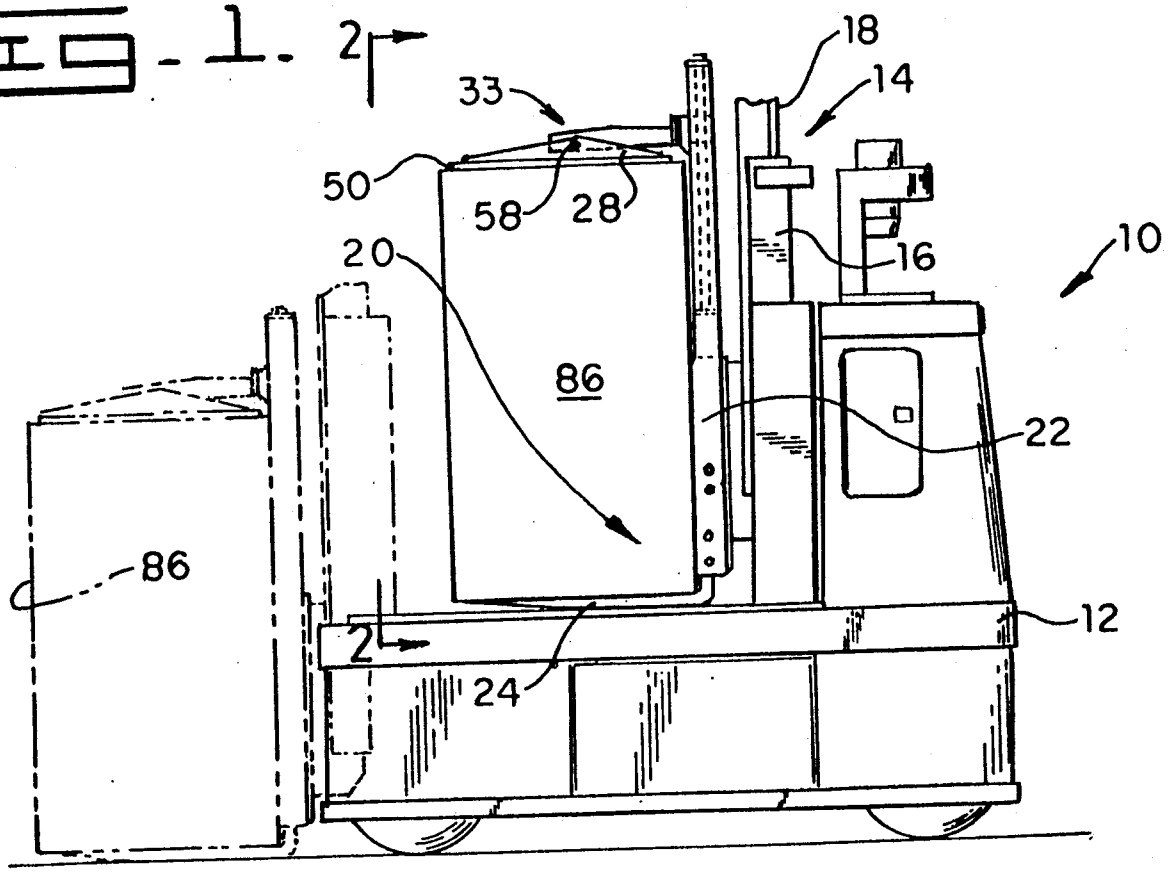
FIG. 1 is a diagrammatic side elevational view of an embodiment of a clamping arrangement of the present invention shown mounted on a material handling vehicle.

With reference to the drawings and particularly FIG. 1, a material handling vehicle 10, which is shown as but not limited to a driverless automatic guided vehicle (AGV), has a frame 12 and lift mast 14 mounted on the frame 12. The lift mast 14 has a first pair of spaced apart elevationally oriented uprights 16 which are mounted on the frame 12 and movable along longitudinally oriented guide rails (not shown) on the vehicle frame 12 between a load carrying position (shown in solid lines) and a load lifting position (shown in phantom lines). The lift mast 14 has a second pair of spaced apart uprights 18 nested between the first pair of uprights 16 and guided by the first pair of uprights 16 for elevational movement in any suitable manner (such as rollers).

Figure 2:
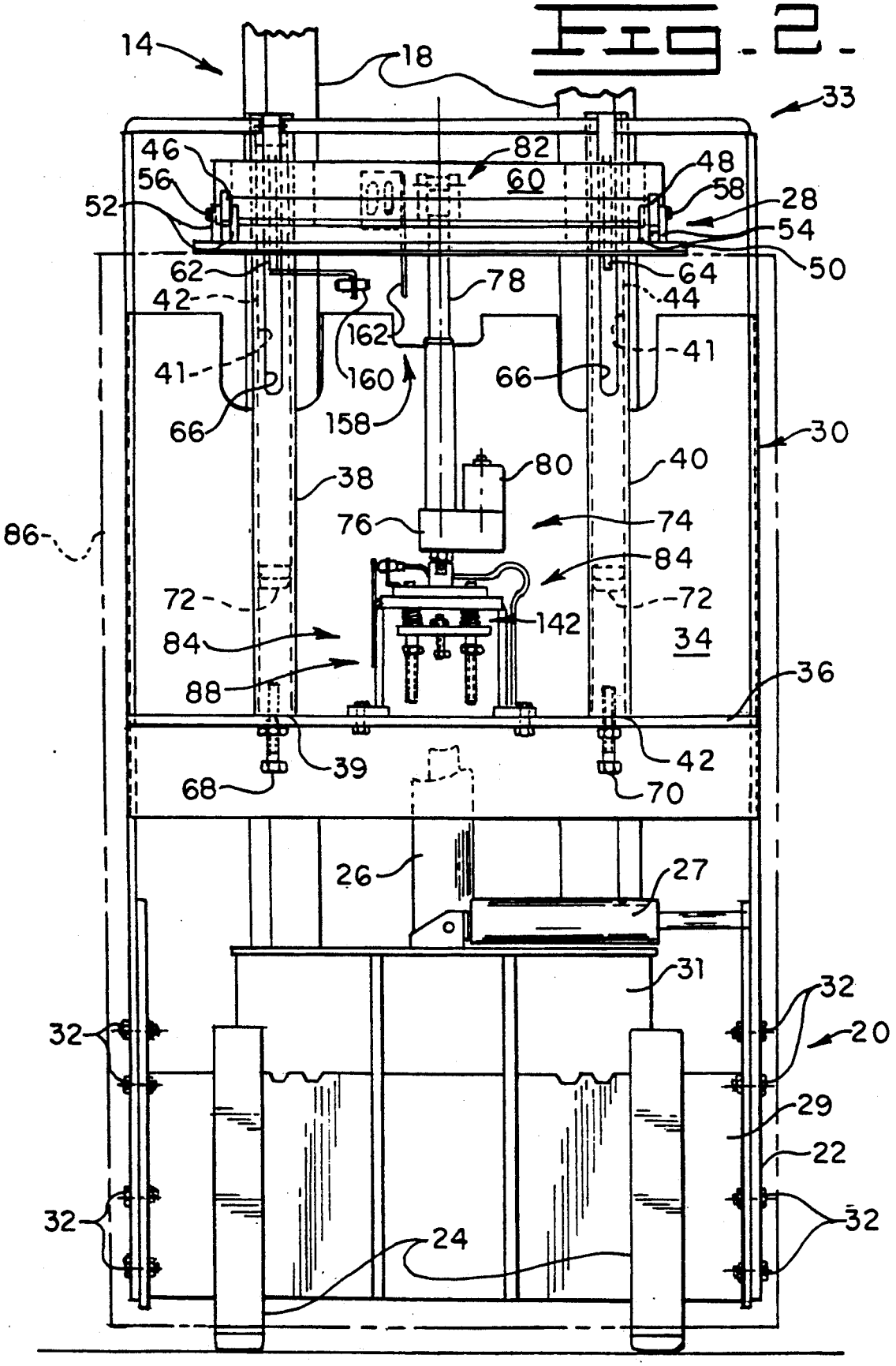
FIG. 2 is a diagrammatic partial front view of the clamping arrangement taken along lines II—II of FIG. 1.

As best seen in FIG. 2, a load engaging device 20 has a carriage 22 which is mounted on the second pair of uprights 18 and guided thereby for elevational movement along the second pair of uprights 18 in any conventional manner such as by rollers (not shown). It is to be noted that the second pair of uprights 18 may be eliminated in situations where high lift is not required. In such applications the carriage 22 is mounted on and elevationally movable along the first pair of uprights 16. The load engaging device 20 also includes a pair of load engaging forks 24 which are mounted at spaced apart locations on the carriage 22 and extend outward from the carriage 22 and substantially normal to the second pair of uprights 18. A hydraulically operated lift jack 26 is connected to the first pair of uprights 16 and the second pair of uprights 18 in any suitable conventional manner. The second pair of uprights 18 is elevationally movable in response to extension and retraction of the lift jack 26. The carriage 22, by way of a conventional chain and sheave arrangement (not shown), is connected to and between the lift jack 26 and carriage 22. The carriage 22 is elevationally moveable in response to extension and retraction of the lift jack 26. A side shift cylinder 27, of any conventional design, is connected between a transversely movable portion 29 of the carriage 22 and a transversely stationary portion 31 of the carriage 22 which carries the above-mentioned rollers. The transverse movement referred to is relative to the uprights 18. The side shift cylinder 27 is suitable for moving the movable portion 29 of the carriage 22 relative to the transversely stationary portion 31 of the carriage 22 and thereby place the forks 24 at a desired location.

A clamping arrangement 33 for stabilizing a load 86 on the load engaging device 20 includes a load engaging clamp 28 which is connected to the load engaging device 20 and particularly to a support frame 30 which is connected to the carriage 22 by fasteners 32. The load engaging clamp 28 is movable between first and second elevationally spaced apart positions relative to the load engaging device 20 and particularly the first and second forks 24. The support frame 30 is rectangular in shape and has cross plate 34 and ledge 36 to provide for rigidity and to prevent the parallelogramming thereof. First and second spaced apart elevationally oriented parallel guide members 38, 40 of tubular cross section are connected to the support frame 30 and abut the ledge 36 at one end 39 of the guide members 38, 40. The first and second guide members 38, 40 each define a guideway 41 in which first and second guided members 42, 44 of cylindrical configuration are respectively slidably disposed. The first and second guided members 42, 44 are connected to first and second arms 46, 48 and support the first and second arms 46, 48 for elevational movement. The first and second arms 46, 48 are disposed between first and second pairs of spaced apart gussets 52, 54 which are mounted at spaced apart locations on a clamp head 50 and pivotally connected to the respective first and second pairs of gussets by pivot pins 56, 58. The clamp head 50 has a rectangular shape and constructed of any suitable material such as plate steel. The first and second arms 46, 48 are connected to a cross beam 60 which in turn is connected to the first and second guided members 42, 44 by first and second support flanges 62, 64, respectively. Each of the first and second guide members 38, 40 have an axially oriented elongated slot 66 disposed therein. The elongated slots 66 allow for the first and second support flanges 62, 64 to extend through the slots 66 and also prevent rotation of the first and second guided members 42, 44 in the guideways 41 of the first and second guide members 38, 40.

First and second stops 68, 70 are connected to the ledge member 36 and engageable with the first and second guided members 42, 44 at a first end 72 thereof in response to the load engaging clamp 28 being at the second position. The guided members 42, 44 move in response to movement of the load engaging clamp 28 between its first and second spaced apart positions and maintains the load engaging clamp 28 from cocking, skewing and the like. The stops 68, 70 are preferably threaded fasteners which are screwthreadably adjustably connected to the ledge 36 so that the location of the second position may be varied.

An actuator means 74 is provided for moving the load engaging clamp between the first and second positions in response to movement of the actuator means 74 between extended and retracted positions. The actuator means 74 preferably is a linear actuator of conventional design having a housing 76 and a rod 78 connected to the housing 76 and extensibly movable relative to the housing 76 between extended and retracted positions. The rod 78 is driven linearly by an electric motor 80 mounted on the housing 76. The actuator rod 78 is connected to the cross beam 60 of the load engaging clamp 28 by a clevis and pin arrangement 82 and the load engaging clamp 28 is movable between the first and second positions in response to the rod moving between the extended and retracted positions.

A connecting means 84 is provided for connecting the actuator means 74 to the load engaging device 20 and maintaining the load engaging clamp 28 from movement toward the second position in response to engagement between the load engaging clamp 28 and a load 86. The connecting means 84 also provides a preselected amount of movement of the actuator means 74 relative to the load engaging clamp 28 subsequent to engagement between the load 86 and load engaging clamp 28. It is to be noted that the connecting means 84 may be connected to either the load engaging clamp 28 or load engaging device 20 and to either the rod 78 or housing 76 of the actuator means 74 without departing from the spirit of the invention. The connecting means 84 also includes means 88 for limiting the applied force of the load engaging clamp 28 against the load 86 to a preselected magnitude and prevent excessive loading of the load.

Figure 4:
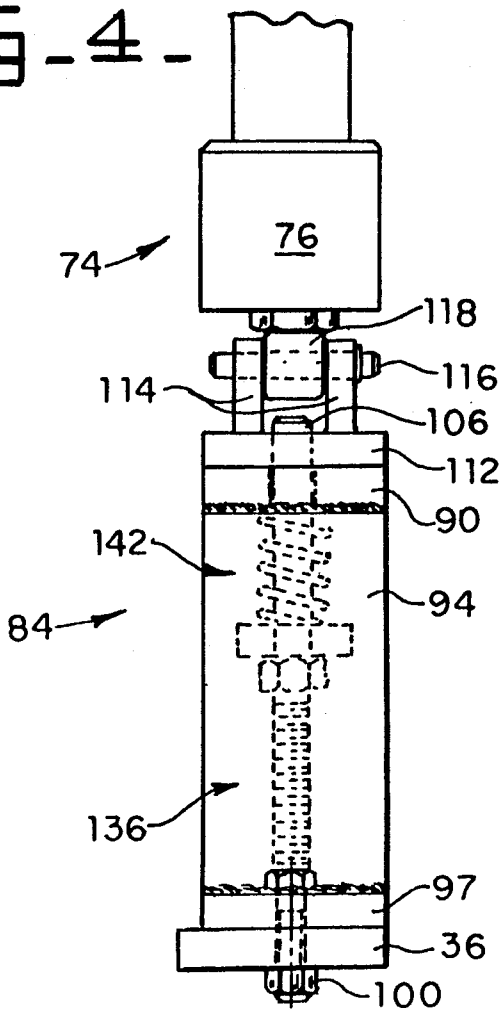
FIG. 4 is a diagrammatic side elevational view of the connecting device taken along lines IV—IV of FIG. 3.
Figure 3:
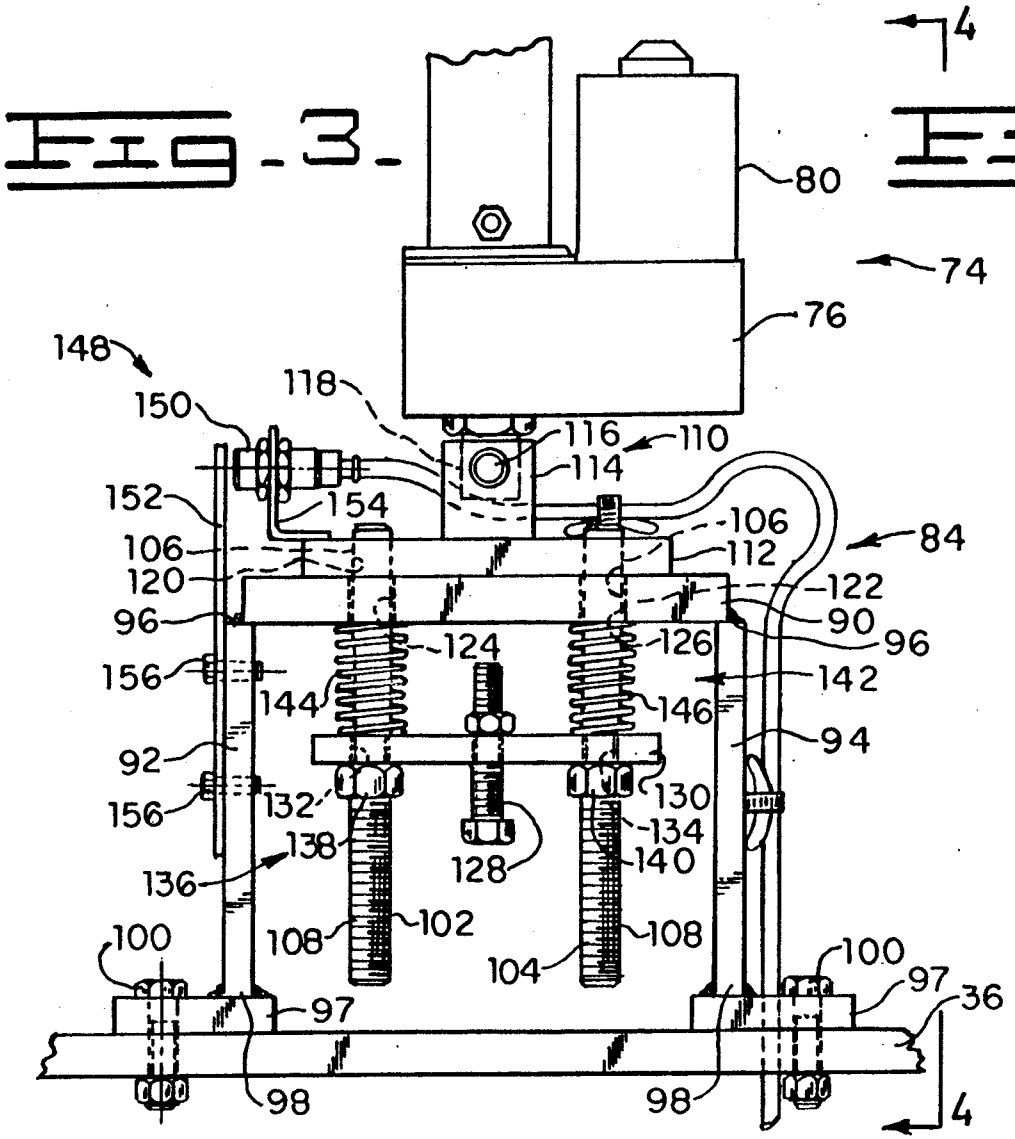
FIG. 3 is a diagrammatic enlarged detail of a connecting device of the clamping arrangement.

As best seen in FIGS. 3 and 4, the connecting means 84 includes a flange 90 which is connected to the load engaging device 20. Specifically, first and second spaced apart substantially parallel sides 92, 94 are connected at a first end 96 thereof to the flange 90 in any suitable manner, such as by welding. The first and second sides 92, 94 preferably but not necessarily extend normally from the flange 90. A foot 97 is connected to a second end 98 of each of the first and second sides 92, 94, such as by welding. Each foot 97 is secured to the ledge 36 of the load engaging device 20 by a plurality of threaded fasteners 100.

The connecting means 84 has first and second guide rods 102, 104 each having first and second end portions 106, 108. The guide rods 102, 104 are preferably elongate round rods having threads 110 disposed along the second end portion 108. The first and second guide rods 102, 104 are connected to the actuator means 74 by a bracket assembly 110 having a connecting flange 112, a clevis 114 mounted on the connecting flange 112, and a pin 116 which pivotally connects the clevis 114 to a stub shaft 118 mounted on the housing 76 of the actuator means 74. The first end portions 106 of the first and second guide rods 102, 104 are disposed in first and second spaced apart apertures 120, 122 in the connecting flange 112 and secured to the connecting flange 112 in any suitable manner such as, press fitting, welding and the like. The first and second guide rods 102, 104 are substantially parallel to each other and extend substantially parallel relative to the longitudinal axis of rod 78 at an unloaded and free hanging position. The flange 90 has first and second spaced apart clearance apertures 124, 126 for receiving the first and second guide rods 102, 104 and allowing slidable movement of the guide rods 102, 104 relative to the flange 90 until the preselected amount of movement of the actuator means 74 is used up.

The preselected amount of movement of the actuator means 74 relative to the load engaging clamp 28 is determined by a stop 128 which is connected to the first guide rod 102 and movable with the actuator means 74 between a first position spaced from the flange 90 and a second position engaged with the flange 90. The first and second guide rods 102, 104 are disposed in first and second spaced apart apertures 132, 134 in a plate member 130 and the plate member is retained on the guide rods 102, 104 by urging means 136. The plate member 130 is slidably movable along the guide rods 102, 104. The urging means 136 includes first and second nuts 138, 140 which are screw threadably engaged with a threaded second end portion 108 of the first and second guide rods 102, 104. The nuts 138, 140 provide for adjustment of the plate member 130 relative to the connecting flange 112 by varying the distance between the plate member 130 and the connecting flange 112. The stop 128 is preferably connected to the plate member 130 between the first and second apertures 132, 134. The stop 128 is screwthreadably engaged with the plate member 130 and adjustable relative to the plate member 130 to vary the distance of movement of the actuator means 74 relative to the load engaging device 20. Therefore, the stop 128 is movable with the plate member 130 between a first position spaced from the flange 90 and a second position engageable with the flange 90. This movement defines the amount of movement of the actuator means 74 relative to the load engaging clamp 28 after engagement with the load 86.

The limiting means 88 includes a biasing means 142, such as first and second coil springs 144, 146, which are disposed between the plate member 130 and the flange 90. The first and second coil springs 144, 146 are preferably disposed about the first and second guide rods 102, 104, respectively. By adjusting the position of the urging means 136 along the guide rods 102, 104 the distance between the plate member 130 and the flange 90 is varied and the preload of the biasing means 142 is settable to a desired value. This preload force and rating of the springs establishes the force of the load engaging clamp 28 being applied to the load 86.

A first sensing means 148 is provided for sensing the position of the actuator means 74 relative to the flange 90 and delivering an actuator stopping control signal in response to the stop 128 being substantially at its second position. The first sensing means 148 includes means 150 for delivering electromagnetic radiation and an actuator stopping control signal in response to a change in the inductance of the electromagnetic radiation. Preferably, but not necessarily, the first sensing means 148 includes a proximity switch which utilizes electromagnetic radiation in the form of an alternating magnetic field to sense when a metallic target 152 or the like is adjacent the proximity switch. The overall inductance of the delivering means 150 changes when a metallic material is within a predetermined distance from the delivering means 150. Proximity switches are well known by those skilled in the art and thus will not be discussed in any greater detail. The delivering means 150 is mounted on the actuator means 74, particularly the connecting flange 112, by a bracket 154, and the metallic target 152, which is preferably an elongated plate is mounted on the flange 90. At the second position of the stop 128, the metallic target 152 is spaced a distance great enough from the delivering means 150 so that the inductance of the electromagnetic radiation is not affected by the metallic target 152. As a result the delivering means 150 delivers an actuator stopping control signal (changes state) to the onboard computer. The motor 80 responds to this actuator stopping control signal and ceases further retraction of the rod 78 and movement of the load engaging clamp 28 toward the second position. It should be noted that the maximum force applied to the load 86 is therefore based on the force required to compress springs 144, 146. The stopping of the actuator means 74 at or just prior to engagement of the stop 128 with the plate 90 is achieved by the sensing means 148. One should observe that the load engaging clamp securely retains the load 86 on the forks 24 when the stop 128 is between its first and second positions. To properly adjust the position of the metallic target 152, threaded fasteners 156 are disposed in elongated slots (not shown) in the bracket 154.

As best seen in FIG. 2, a second sensing means 158 is provided for sensing the elevational position of the load engaging clamp 128 and delivering an actuator means 74 stopping control signal in response to the load engaging clamp 128 being at its first position. The second sensing means 158 includes means 160 for delivering electromagnetic radiation, preferably light waves, for receiving a reflection of the electromagnetic radiation and delivering an actuator stopping control signal in response to receiving a reflection of the electromagnetic radiation. The second sensing means 148 includes a reflective target 162. The delivering means 160 is connected to the load engaging device 20 and the reflective target 162 is connected to the load engaging clamp 28 at any suitable location thereon. The reflective target 162 has an elongated plate with a retroreflective tape attached to an appropriate area thereof so that the electromagnetic radiation reflection is received by the delivering means 160 at the first position of the load engaging clamp 28. The reflective target 162 is adjustable in a manner similar to that of the metallic target 152 so that the timing of the stopping of the actuator means 74 occurs when the load engaging clamp 28 is at the first position. The motor 80 responds to this actuator stopping control signal and ceases further extension of the rod 78 and movement of the load engaging clamp 28 toward the first position when at the first position.

INDUSTRIAL APPLICABILITY

With reference to the drawings, and in operation, the AGV 10 maneuvers along a preprogrammed path within the facility of operation and guides itself into alignment with the load 86 to be lifted. It is to be noted that the vehicle guidance functions and load engaging functions are controlled by at least one computer (not shown) located onboard the AGV. Since computers of this type are well known in the art no further discussion related thereto will be made. Once the vehicle 10 is in position the lift mast 14 is then moved from the load carry position, as shown in solid lines, to the load lifting position, as shown in phantom lines. The side shift cylinder 27 is then actuated by the computer to move the movable carriage portion 29 and place the forks 24 in position to engage the load 86. Once the forks 24 are in position the AGV is driven toward the load 86 until the forks 24 are placed beneath and against the load 86. The carriage lift jack 26 is then actuated and the carriage 22 and load 86 carried on the forks 22 is elevated to a desired position.

Prior to elevation of the carriage 22, the load engaging clamp 28, under the power of the actuator means 74, is moved from the first position toward the second position. Upon engagement of the clamp head 50 with the load 86 the connecting means 84 allows relative movement between the actuator means 74 and the load engaging device 20 (carriage 22). This movement is provided so that variations in the actual size of the load 86 from the nominal may be accommodated without over loading. This movement is achieved by allowing the first and second guide rods 102, 104, which are connected to the actuator means 74, to slidably move relative to the flange 90.

The biasing means 142, by virtue of its location between the flange 90 and the plate member 130 limits the amount of force of the load engaging clamp 28 to be applied to the load 86 to a preselected value suitable for holding the load on the forks 24 without damaging the load 86, during movement of the plate member 130 toward the flange 90 (movement of the actuator means 74 relative to the load engaging device 20).

The stop 128 moves with the plate member 130 during movement of the plate member 130 between its first and second positions and controls the amount of movement of the actuator means 74 relative to the load engaging device 20 to a preselected adjustable amount. At or just prior to engagement of the stop 128 with the flange 90 the first sensing means 148 will deliver a signal to the vehicle computer indicating that the amount of relative movement of the actuator means 74 is at its predetermined allowable maximum limit. The computer, based on preprogrammed instructions will cause the motor 80 of the actuator means 74 to cease operation. It should be noted that at this point in the clamping operation the maximum amount of force applied to the load 86 has been achieved.

The carriage and the load 86 is then elevated to the proper height and the lift mast 14 is moved to the carry position on the vehicle 10. The vehicle then travels to a load deposit location at which substantially a reversal of the aforementioned operation takes place and the load is deposited. It is to be recognized that when the load 86 is to be deposited the load engaging clamp 28 is moved to its first position prior to withdrawal of the forks 24 from beneath the load 86. The second sensing means 158 identifies when the load is at the first position and delivers a signal to the computer which results in the stopping of the actuator means 74.

The connecting means 84, and first and second sensing means 148, 158 each serve to provide a simple, efficient and inexpensive way to retain loads 86 of differing sizes supported on forks 24 of a load engaging device 20 without the threat of over loading the load 86 or inadvertent movement of the load 86. The construction of the aforementioned clamping arrangement 33 also facilitates simple adjustment of the limiting means 88, and particularly the stop 128 and urging means 136 so that the range of movement of the stop between the first and second positions and the preload of springs 144, 146 may be easily changed.

Other aspects, objects and advantages of the present invention can be obtained from a study of the drawings, the disclosure and the appended claims.

I claim:

1. A lift mast having a pair of spaced apart uprights, a carriage and a plurality of load engaging forks mounted on the carriage and extending from the carriage in a direction transverse the uprights, said carriage being mounted on the pair of uprights and elevationally movable along the pair of uprights between spaced apart locations, and means for moving the carriage along the uprights, comprising:

an elongated first guide member mounted on the carriage and oriented in an axial direction transverse the direction of extension of the forks;

a first guided member being slidably connected to said elongated guide member and moveable in directions along said guide member;

a load engaging clamp connected to the first guided member and movable in a transverse direction relative to the load engaging forks between first and second elevationally spaced apart locations from the forks in response to movement of the first guided member;

an actuator having a housing and a rod slidably connected to the housing and selectively extensibly movable relative to the housing between extended and retracted positions;

means for attaching one of said rod and housing to the load engaging clamp;

means for connecting the other one of the housing and the rod to the carriage and maintaining said load engaging clamp from movement toward said second position during extensible movement of said rod in response to engagement between the load engaging clamp and the load, said connecting means including a biasing means for permitting a preselected amount of extensible movement of the actuator relative to the load engaging clamp subsequent to engagement between the load engaging clamp and the load, and limiting the applied force of the load engaging clamp against the load to a preselected magnitude.

2. A lift mast, as set forth in claim 1, wherein said connecting means includes:

a flange having first and second spaced apart apertures disposed therethrough and being connected to the carriage;

first and second spaced apart substantially parallel guide rods connected to the housing and extending from said housing substantially parallel to said actuator rod, said first and second guide rods being disposed in the first and second apertures of the flange;

a plate member having first and second spaced apart apertures disposed therethrough, said first and second rods being disposed in the first and second apertures of the plate member;

a biasing means for urging the plate member apart from the flange and limiting the applied force of the load engaging clamp against the load to said preselected magnitude.

3. A lift mast, as set forth in claim 2, including a stop connected to the plate member and movable with the plate member between a first position spaced from said flange and a second position engaged with the flange, said first and second positions of the plate member defining the preselected amount of extension of the actuator relative to the load engaging clamp.

4. A lift mast, as set forth in claim 3, including a first means for sensing the position of the actuator relative to the flange and delivering an actuator stopping control signal in response to said stop being at the second position.

5. A lift mast, as set forth in claim 4, wherein said first sensing means includes:

means for delivering electromagnetic radiation and an actuator stopping control signal in response to a change in the inductance of the delivered electromagnetic radiation, said delivering means being mounted on the actuator; and a metallic target mounted on the flange and adapted to change the inductance of the electromagnetic radiation in response to the stop being at said second position.

6. A lift mast, as set forth in claim 5 including a second sensing means for sensing the position of the load engaging clamp relative to said forks and delivering an actuator stopping control signal in response to the load engaging clamp being at the first position.

7. A lift mast, as set forth in clam 6, wherein said second sensing means includes:

means for delivering electromagnetic radiation, for receiving a reflection of the delivered electromagnetic radiation and delivering an actuator stopping control signal in response to receiving a reflection of the electromagnetic radiation, said delivering means of the second sensing means being mounted on the carriage; and a reflective target mounted on the load engaging clamp and being adapted to deliver a reflection of said electromagnetic radiation at the first position of the load engaging clamp.

8. A lift mast, as set forth in claim 2, wherein said biasing means includes first and second coil springs disposed about the first and second guide rods, respectively, and including means for urging the first and second coil springs against the flange and adjusting the preload of the coil springs.

9. A lift mast, as set forth in claim 1, wherein said elongated member has a guide way and said first guided member being slidably disposed in the guide way, including:

a first arm connected to the guided member and extending outwardly from the guided member;

a clamp head pivotally connected to the first arm, said attaching means pivotally connecting said first arm to the actuator rod and said first arm being movable in response to extensible movement of the actuator rod.

10. A lift mast, as set forth in claim 9, wherein said guide member includes an elongated slot and said first arm extends through said elongated slot in a direction transverse the first elongated member.

11. A lift mast, as set forth in claim 1, where said attaching means includes a clevis member and a pn, said clevis member and pin attaching the rod to said load engaging clamp and said connecting means connecting said housing to said carriage.

* * * * *